US008901850B2

(12) United States Patent
Maxik et al.

(10) Patent No.: US 8,901,850 B2
(45) Date of Patent: Dec. 2, 2014

(54) ADAPTIVE ANTI-GLARE LIGHT SYSTEM AND ASSOCIATED METHODS

(71) Applicant: Lighting Science Group Corporation, Satellite Beach, FL (US)

(72) Inventors: Frederic S. Maxik, Indialantic, FL (US); Robert R. Soler, Cocoa Beach, FL (US); David E. Bartine, Cocoa, FL (US)

(73) Assignee: Lighting Science Group Corporation, Satellite Beach, FL (US)

( * ) Notice: Subject to any disclaimer, the term of this patent is extended or adjusted under 35 U.S.C. 154(b) by 18 days.

(21) Appl. No.: 13/792,354

(22) Filed: Mar. 11, 2013

(65) Prior Publication Data

US 2013/0293150 A1 Nov. 7, 2013

Related U.S. Application Data

(63) Continuation-in-part of application No. 13/775,936, filed on Feb. 25, 2013.

(60) Provisional application No. 61/643,316, filed on May 6, 2012.

(51) Int. Cl.
*H05B 33/08* (2006.01)

(52) U.S. Cl.
CPC ..... *H05B 33/0872* (2013.01); *H05B 33/086* (2013.01)
USPC ..... 315/297; 315/308; 315/312; 362/545; 362/231

(58) Field of Classification Search
CPC ..... H05B 33/0803; H05B 33/0863; H05B 37/029; H05B 33/0857; H05B 33/0869; H05B 33/086; H05B 33/0872; H05B 37/02; H05B 33/0815; G02B 27/0994; G02B 6/0028; G02B 19/0066
USPC ..... 315/82, 151, 154–159, 291, 307, 297; 362/84, 231, 276, 802, 249.02, 431; 345/426, 428, 589, 204, 207, 211, 214, 345/690–691, 22, 45–46, 48, 63–64, 76–77, 345/84
See application file for complete search history.

(56) References Cited

U.S. PATENT DOCUMENTS 5,523,878 A 6/1996 Wallace et al.
5,680,230 A 10/1997 Kaburagi et al.
(Continued)

FOREIGN PATENT DOCUMENTS

CN 101702421 A 5/2010
DE 202011000007 U1 6/2012
(Continued)

OTHER PUBLICATIONS

U.S. Appl. No. 13/311,300, filed Dec. 2011, Fredric S. Maxik et al.
(Continued)

*Primary Examiner* — Thienvu Tran
*Assistant Examiner* — Christopher Lo
(74) *Attorney, Agent, or Firm* — Mark R. Malek; William A. Harding; Zies Widerman & Malek

(57) ABSTRACT

An adaptive anti-glare light system including a sensor, a color selection engine, a controller, and a plurality of light sources each configured to emit a source light. The sensor transmits a source color signal designating a reflected light characterized by a detected color and a discomfort glare rating. The color selection engine determines a dominant wavelength of the detected color, and a combination of the light sources that the controller may operate to emit a combined wavelength that matches the dominant wavelength of the detected color. A method of adapting light as a countermeasure to glare comprises receiving the detected color, determining a subset of the plurality of light sources that may be combined to form an adapted light that matches the detected color, and operating the light sources with a white light to emit the adapted light at or above a threshold discomfort glare level.

23 Claims, 11 Drawing Sheets

(56) References Cited

U.S. PATENT DOCUMENTS 5,704,701 A 1/1998 Kavanagh et al.
5,813,753 A 9/1998 Vriens et al.
5,997,150 A 12/1999 Anderson
6,140,646 A 10/2000 Busta et al.
6,259,572 B1 7/2001 Meyer, Jr.
6,341,876 B1 1/2002 Moss et al.
6,356,700 B1 3/2002 Strobl
6,450,652 B1 9/2002 Karpen
6,459,919 B1 10/2002 Lys et al.
6,528,954 B1 3/2003 Lys et al.
6,550,949 B1 * 4/2003 Bauer et al. ..... 362/545
6,561,656 B1 5/2003 Kojima et al.
6,577,080 B2 6/2003 Lys et al.
6,586,882 B1 7/2003 Harbers
6,594,090 B2 7/2003 Kruschwitz et al.
6,733,135 B2 5/2004 Dho
6,734,639 B2 5/2004 Chang et al.
6,762,562 B2 7/2004 Leong
6,767,111 B1 7/2004 Lai
6,787,999 B2 9/2004 Stimac et al.
6,817,735 B2 11/2004 Shimizu et al.
6,870,523 B1 3/2005 Ben-David et al.
6,871,982 B2 3/2005 Holman et al.
6,909,377 B2 6/2005 Eberl
6,967,761 B2 11/2005 Starkweather et al.
6,974,713 B2 12/2005 Patel et al.
7,009,343 B2 3/2006 Lim et al.
7,034,934 B2 4/2006 Manning
7,042,623 B1 5/2006 Huibers et al.
7,058,197 B1 6/2006 McGuire et al.
7,070,281 B2 7/2006 Kato
7,072,096 B2 7/2006 Holman et al.
7,075,707 B1 7/2006 Rapaport et al.
7,083,304 B2 8/2006 Rhoads
7,095,053 B2 8/2006 Mazzochette et al.
7,144,131 B2 12/2006 Rains
7,157,745 B2 1/2007 Blonder et al.
7,178,941 B2 2/2007 Roberge et al.
7,184,201 B2 2/2007 Duncan
7,187,484 B2 3/2007 Mehrl
7,213,926 B2 5/2007 May et al.
7,234,844 B2 6/2007 Bolta et al.
7,246,923 B2 7/2007 Conner
7,247,874 B2 7/2007 Bode et al.
7,252,408 B2 8/2007 Mazzochete et al.
7,255,469 B2 8/2007 Wheatley et al.
7,261,453 B2 8/2007 Morejon et al.
7,289,090 B2 10/2007 Morgan
7,300,177 B2 11/2007 Conner
7,303,291 B2 12/2007 Ikeda et al.
7,319,293 B2 1/2008 Maxik
7,324,076 B2 1/2008 Lee et al.
7,325,956 B2 2/2008 Morejon et al.
7,342,658 B2 3/2008 Kowarz et al.
7,344,279 B2 3/2008 Mueller et al.
7,349,095 B2 3/2008 Kurosaki
7,353,859 B2 4/2008 Stevanovic et al.
7,369,056 B2 5/2008 McCollough et al.
7,382,091 B2 6/2008 Chen
7,382,632 B2 6/2008 Alo et al.
7,400,439 B2 7/2008 Holman
7,427,146 B2 9/2008 Conner
7,429,983 B2 9/2008 Islam
7,434,946 B2 10/2008 Huibers
7,436,996 B2 10/2008 Ben-Chorin
7,438,443 B2 10/2008 Tatsuno et al.
7,476,016 B2 1/2009 Kurihara
7,497,596 B2 3/2009 Ge
7,520,607 B2 4/2009 Casper et al.
7,520,642 B2 4/2009 Holman et al.
7,521,875 B2 4/2009 Maxik
7,524,097 B2 * 4/2009 Turnbull et al. ..... 362/545
7,528,421 B2 5/2009 Mazzochete
7,530,708 B2 5/2009 Park
7,537,347 B2 5/2009 Dewald
7,540,616 B2 6/2009 Conner
7,556,376 B2 7/2009 Ishak et al.
7,556,406 B2 7/2009 Petroski et al.
7,573,210 B2 8/2009 Ashdown et al.
7,598,686 B2 10/2009 Lys et al.
7,598,961 B2 10/2009 Higgins
7,605,971 B2 10/2009 Ishii et al.
7,619,372 B2 11/2009 Garrity
7,626,755 B2 12/2009 Furuya et al.
7,633,093 B2 12/2009 Blonder et al.
7,633,779 B2 12/2009 Garrity et al.
7,637,643 B2 12/2009 Maxik
7,677,736 B2 3/2010 Kazasumi et al.
7,678,140 B2 3/2010 Brainard et al.
7,679,281 B2 3/2010 Kim et al.
7,684,007 B2 3/2010 Hull et al.
7,703,943 B2 4/2010 Li et al.
7,705,810 B2 4/2010 Choi et al.
7,708,452 B2 5/2010 Maxik et al.
7,709,811 B2 5/2010 Conner
7,719,766 B2 5/2010 Grasser et al.
7,728,846 B2 6/2010 Higgins et al.
7,732,825 B2 6/2010 Kim et al.
7,748,845 B2 7/2010 Casper et al.
7,759,854 B2 7/2010 Miller et al.
7,766,490 B2 8/2010 Harbers et al.
7,819,556 B2 10/2010 Heffington et al.
7,828,453 B2 11/2010 Tran et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,841,714 B2 11/2010 Grueber
7,845,823 B2 12/2010 Mueller et al.
7,855,376 B2 12/2010 Cantin et al.
7,871,839 B2 1/2011 Lee
7,880,400 B2 2/2011 Zhoo et al.
7,889,430 B2 2/2011 El-Ghoroury et al.
7,906,789 B2 3/2011 Jung et al.
7,928,565 B2 4/2011 Brunschwiler et al.
7,972,030 B2 7/2011 Li
7,976,182 B2 7/2011 Ribarich
7,976,205 B2 7/2011 Grotsch et al.
8,016,443 B2 9/2011 Falicoff et al.
8,040,070 B2 10/2011 Myers et al.
8,047,660 B2 11/2011 Penn et al.
8,049,763 B2 11/2011 Kwak et al.
8,061,857 B2 11/2011 Liu et al.
8,070,302 B2 12/2011 Hatanaka et al.
8,076,680 B2 12/2011 Lee et al.
8,083,364 B2 12/2011 Allen
8,096,668 B2 1/2012 Abu-Ageel
8,096,675 B1 * 1/2012 Posselt ..... 362/230
8,115,419 B2 2/2012 Given et al.
8,149,406 B2 4/2012 Bergman et al.
8,164,844 B2 4/2012 Toda et al.
8,182,106 B2 5/2012 Shin
8,182,115 B2 5/2012 Takahashi et al.
8,188,687 B2 5/2012 Lee et al.
8,192,047 B2 6/2012 Bailey et al.
8,207,676 B2 6/2012 Hilgers
8,212,836 B2 7/2012 Matsumoto et al.
8,253,336 B2 8/2012 Maxik et al.
8,256,921 B2 9/2012 Crookham et al.
8,274,089 B2 9/2012 Lee
8,297,783 B2 10/2012 Kim
8,304,978 B2 11/2012 Kim et al.
8,310,171 B2 11/2012 Reisenauer et al.
8,314,569 B2 11/2012 Adamson et al.
8,319,445 B2 11/2012 McKinney et al.
8,324,808 B2 12/2012 Maxik et al.
8,324,823 B2 12/2012 Choi et al.
8,324,840 B2 12/2012 Shteynberg et al.
8,331,099 B2 12/2012 Geissler et al.
8,337,029 B2 12/2012 Li
8,378,574 B2 2/2013 Schlangen et al.
8,401,231 B2 3/2013 Maxik et al.
8,491,165 B2 7/2013 Bretschneider et al.
2002/0113555 A1 8/2002 Lys et al.

(56) References Cited

U.S. PATENT DOCUMENTS

| | | | |
|---|---|---|---|
| 2004/0052076 | A1 | 3/2004 | Mueller et al. |
| 2004/0093045 | A1 | 5/2004 | Bolta |
| 2004/0119086 | A1 | 6/2004 | Yano et al. |
| 2005/0189557 | A1 | 9/2005 | Mazzochete et al. |
| 2005/0218780 | A1 | 10/2005 | Chen |
| 2005/0267213 | A1 | 12/2005 | Gold et al. |
| 2006/0002108 | A1 | 1/2006 | Ouderkirk et al. |
| 2006/0002110 | A1 | 1/2006 | Dowling et al. |
| 2006/0164005 | A1 | 7/2006 | Sun |
| 2006/0285193 | A1 | 12/2006 | Kimura et al. |
| 2007/0013871 | A1 | 1/2007 | Marshall et al. |
| 2007/0159492 | A1 | 7/2007 | Lo et al. |
| 2007/0262714 | A1 | 11/2007 | Bylsma |
| 2008/0119912 | A1 | 5/2008 | Hayes |
| 2008/0143973 | A1 | 6/2008 | Wu |
| 2008/0198572 | A1 | 8/2008 | Medendorp |
| 2008/0232084 | A1 | 9/2008 | Kon |
| 2009/0059585 | A1 | 3/2009 | Chen et al. |
| 2009/0128781 | A1 | 5/2009 | Li |
| 2009/0232683 | A1 | 9/2009 | Hirata et al. |
| 2009/0273931 | A1 | 11/2009 | Ito et al. |
| 2009/0303694 | A1 | 12/2009 | Roth et al. |
| 2010/0001652 | A1 | 1/2010 | Damsleth |
| 2010/0006762 | A1 | 1/2010 | Yoshida et al. |
| 2010/0051976 | A1 | 3/2010 | Rooymans |
| 2010/0053959 | A1 | 3/2010 | Ijzerman et al. |
| 2010/0076250 | A1 | 3/2010 | Van Woudenberg |
| 2010/0103389 | A1 | 4/2010 | McVea et al. |
| 2010/0157573 | A1 | 6/2010 | Toda et al. |
| 2010/0202129 | A1 | 8/2010 | Abu-Ageel |
| 2010/0213859 | A1 | 8/2010 | Shteynberg et al. |
| 2010/0231131 | A1 | 9/2010 | Anderson |
| 2010/0231863 | A1 | 9/2010 | Hikmet et al. |
| 2010/0244700 | A1 | 9/2010 | Chong et al. |
| 2010/0244724 | A1 | 9/2010 | Jacobs et al. |
| 2010/0244735 | A1 | 9/2010 | Buelow, II |
| 2010/0244740 | A1 | 9/2010 | Alpert et al. |
| 2010/0270942 | A1 | 10/2010 | Hui et al. |
| 2010/0277084 | A1 | 11/2010 | Lee et al. |
| 2010/0277316 | A1 | 11/2010 | Schlangen |
| 2010/0302464 | A1 | 12/2010 | Raring et al. |
| 2010/0308738 | A1 | 12/2010 | Shteynberg et al. |
| 2010/0315320 | A1 | 12/2010 | Yoshida |
| 2010/0320927 | A1 | 12/2010 | Gray et al. |
| 2010/0320928 | A1 | 12/2010 | Kaihotsu et al. |
| 2010/0321641 | A1 | 12/2010 | Van Der Lubbe |
| 2011/0012137 | A1 | 1/2011 | Lin et al. |
| 2011/0080635 | A1 | 4/2011 | Takeuchi |
| 2011/0310446 | A1 | 12/2011 | Komatsu |
| 2012/0250137 | A1 | 10/2012 | Maxik et al. |
| 2012/0285667 | A1 | 11/2012 | Maxik et al. |
| 2012/0286700 | A1 | 11/2012 | Maxik et al. |
| 2013/0070439 | A1 | 3/2013 | Maxik et al. |

FOREIGN PATENT DOCUMENTS

| | | | |
|---|---|---|---|
| EP | 0851260 | | 7/1998 |
| EP | 1662583 | A1 | 5/2006 |
| EP | 1671059 | B1 | 4/2007 |
| EP | 2292464 | A1 | 9/2011 |
| JP | 2008226567 | | 9/2008 |
| WO | WO03098977 | | 11/2003 |
| WO | WO2004011846 | A1 | 2/2004 |
| WO | WO2006001221 | A1 | 1/2006 |
| WO | 2006105649 | A1 | 10/2006 |
| WO | WO2009/121539 | A1 | 10/2009 |
| WO | WO2012064470 | | 5/2012 |
| WO | WO2012135173 | | 10/2012 |
| WO | WO2012158665 | | 11/2012 |
| WO | PCTUS2012067916 | | 12/2012 |

OTHER PUBLICATIONS

U.S. Appl. No. 13/709,942, filed Dec. 2012, Fredric S. Maxik et al.
U.S. Appl. No. 13/715,085, filed Dec. 2012, Fredric S. Maxik et al.
U.S. Appl. No. 13/737,606, filed Jan. 2013, Fredric S. Maxik et al.
U.S. Appl. No. 13/739,665, filed Jan. 2013, Fredric S. Maxik et al.
U.S. Appl. No. 13/753,890, filed Jan. 2013, Fredric S. Maxik et al.
U.S. Appl. No. 13/803,825, filed Mar. 2013, Fredric S. Maxik et al.
U.S. Appl. No. 13/832,459, filed Mar. 2013, Fredric S. Maxik et al.
U.S. Appl. No. 13/837,643, filed Mar. 2013, Fredric S. Maxik et al.
U.S. Appl. No. 13/842,875, filed Mar. 2013, Eric Holland et al.

Akashi, Yukio, et al., Assessment of Headlamp Glare and Potential Countermeasures: Survey of Advanced Front Lighting System (AFS), U.S. Department of Transportation, National Highway Traffic Safety Administration, Contract No. DTNH22-99-D-07005, (Dec. 2005).

Arthur P. Fraas, Heat Exchanger Design, 1989, p. 60, John Wiley & Sons, Inc., Canada.

Boeing, (Jul. 6, 2011), International Space Program, S684-13489 Revision A "ISS Interior Solid State Lighting Assembly (SSLA) Specification", Submitted to National Aeronautics and Space Administration, Johnson Space Center, Contract No. NAS15-10000, pp. 1-60.

Brainard, et al., (Aug. 15, 2001), "Action Spectrum for Melatonin Regulation in Humans: Evidence for a Novel Circadian Photoreceptor", The Journal of Neuroscience, 21(16):6405-6412.

Binnie et al. (1979) "Fluorescent Lighting and Epilepsy" Epilepsia 20(6):725-727.

Bullough, John, et al., "Discomfort Glare from Headlamps: Interactions Among Spectrum, Control of Gaze and Background Light Level", Society of Automotive Engineers, Inc., 2003-01-0296, (2003).

Charamisinau et al. (2005) "Semiconductor laser insert with Uniform Illumination for Use in Photodynamic Therapy" Appl Opt 44(24):5055-5068.

Derlofske, et al., "Headlamp Parameters and Glare", Society of Automotive Engineers, Inc., 2004-01-1280, (2004).

Erba Shedding Light on Photosensitivity, One of Epilepsy's Most Complex Conditions. Photosensitivity and Epilepsy. Epilepsy Foundation. Accessed: Aug. 28, 2009. http://www.epilepsyfoundation.org/aboutepilepsy/seizures/photosensitivity-/gerba.cfm.

Figueiro et al. (2004) "Spectral Sensitivity of the Circadian System" Proc. SPIE 5187:207.

Figueiro et al. (2008) "Retinal Mechanisms Determine the Subadditive Response to Polychromatic Light by the Human Circadian System" Neurosci Lett 438(2):242.

Gabrecht et al. (2007) "Design of a Light Delivery System for the Photodynamic Treatment of the Crohn's Disease" Proc. SPIE 6632:1-9.

H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.

Happawana et al. (2009) "Direct De-Ionized Water-Cooled Semiconductor Laser Package for Photodynamic Therapy of Esophageal Carcinoma: Design and Analysis" J Electron Pack 131(2):1-7.

Harding & Harding (1999) "Televised Material and Photosensitive Epilepsy" Epilepsia 40(Suppl. 4):65.

Hickcox, Sweater K., et al., Lighting Research Center, "Effect of different colored background lighting on LED discomfort glare perception", Proc. of SPIE, vol. 8484, 84840O-1, (2012).

Jones, Eric D., Light Emitting Diodes (LEDS) for General Lumination, an Optoelectronics Industry Development Association (OIDA) Technology Roadmap, OIDA Report, Mar. 2001, published by OIDA in Washington D.C.

J. Y. San, C. H. Huang, M. H, Shu, "Impingement cooling of a confined circular air jet", In t. J. Heat Mass Transf., 1997. pp. 1355-1364, vol. 40.

Kooi, Frank, "Yellow Lessens Discomfort Glare: Physiological Mechanism(S)", TNO Human Factors, Netherlands, Contract No. FA8655-03-1-3043, (Mar. 9, 2004).

Kuller & Laike (1998) "The Impact of Flicker from Fluorescent Lighting on Well-Being, Perfiormance and Physiological Arousal" Ergonomics 41(4):433-447.

Lakatos (2006) "Recent trends in the epidemiology of Inflammatory Bowel Disease: Up or Down?" World J Gastroenterol 12(38):6102.

(56) References Cited

OTHER PUBLICATIONS

Mace, Douglas, et al., "Countermeasures for Reducing the Effects of Headlight Glare", The Last Resource, Prepared for the AAA Foundation for Traffic Safety, pp. 1 to 110, (Dec. 2001).
Mehta, Arpit, "Map Colors of a CIE Plot and Color Temperature Using an RGB Color Sensor", Strategic Applications Engineer, Maxim Integrated Products, A1026, p. 1-11, (2005).
N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.
Ortner & Dorta (2006) "Technology Insight: Photodynamic Therapy for Cholangiocarcinoma" Nat Clin Pract Gastroenterol Hepatol 3(8):459-467.
Rea (2010) "Circadian Light" J Circadian Rhythms 8(1):2.
Rea et al. (2010) "The Potential of Outdoor Lighting for Stimulating the Human Circadian System" Alliance for Solid-State Illumination Systems and Technologies (ASSIST), May 13, 2010, p. 1-11.
Rosco Laboratories Poster "Color Filter Technical Data Sheet: #87 Pale Yellow Green" (2001).
Sivak, Michael, et al., "Blue Content of LED Headlamps and Discomfort Glare", The University of Michigan Transportation Research Institute, Report No. UMTRI-2005-2, pp. 1-18, (Feb. 2005).
S. A Solovitz, L. D. Stevanovic, R. A Beaupre, "Microchannels Take Heatsinks to the Next Level", Power Electronics Technology, Nov. 2006.
Stevens (1987) "Electronic Power Use and Breast Cancer: A Hypothesis" Am J Epidemiol 125(4):556-561.
Stockman, Andrew, "The spectral sensitivity of the human short-wavelength sensitive cones derived from thresholds and color matches", Pergamon, Vision Research 39, pp. 2901-2927 (1999).
Tannith Cattermole, "Smart Energy Class controls light on demand", Gizmag.com, Apr. 18, 2010 accessed Nov. 1, 2011.
Topalkara et al. (1998) "Effects of flash frequency and repetition of intermittent photic stimulation on photoparoxysmal responses" Seizure 7(13):249-253.
Veitch & McColl (1995) "Modulation of Fluorescent Light: Flicker Rate and Light Source Effects on Visual Performance and Visual Comfort" Lighting Research and Technology 27:243-256.
Wang (2005) "The Critical Role of Light in Promoting Intestinal Inflammation and Crohn's Disease" J Immunol 174 (12):8173-8182.
Wilkins et al. (1979) "Neurophysical aspects of pattern-sensitive epilepsy" Brain 102:1-25.
Wilkins et al. (1989) "Fluorescent lighting, headaches, and eyestrain" Lighting Res Technol 21(1):11-18.
Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.
PCT International Search Report dated Dec. 9, 2013 in related patent application PCT/US2013/039682 (4 pages).

* cited by examiner

300

| *Visual Response* | *Rating* |
|---|---|
| Unnoticeable | 9 |
| – | 8 |
| Satisfactory | 7 |
| – | 6 |
| Just Acceptable | 5 |
| – | 4 |
| Disturbing | 3 |
| – | 2 |
| Unbearable | 1 |

301

302

FIG. 3

ADAPTIVE ANTI-GLARE LIGHT SYSTEM AND ASSOCIATED METHODS

RELATED APPLICATIONS

This application is a continuation in part of U.S. patent application Ser. No. 13/775,936 titled Adaptive Light System and Associated Methods, filed on Feb. 25, 2013, which, in turn, claims the benefit of U.S. Provisional Patent Application No. 61/643,316 entitled LUMINAIRE HAVING AN ADAPTABLE LIGHT SOURCE AND ASSOCIATED METHODS filed on May 6, 2012, the entire contents of each of which are incorporated herein by reference. This application is also related to U.S. patent application Ser. No. 13/234,371 filed Sep. 16, 2011, entitled COLOR CONVERSION OCCLUSION AND ASSOCIATED METHODS, U.S. patent application Ser. No. 13/107,928 filed May 15, 2011, entitled HIGH EFFICACY LIGHTING SIGNAL CONVERTER AND ASSOCIATED METHODS, U.S. patent application Ser. No. 13/174,339 filed Jun. 30, 2011, entitled LED LAMP FOR PRODUCING BIOLOGICALLY-CORRECTED LIGHT, U.S. patent application Ser. No. 12/842,887 filed Jul.23, 2010, entitled LED LAMP FOR PRODUCING BIOLGICALLY-CORRECTED LIGHT, and U.S. patent application Ser No. 13/311,300 filed Dec. 5, 2011, entitled TUNABLE LED LAMP FOR PRODUCING BIOLOGICALLY-ADJUSTED LIGHT, the entire contents of each of which are incorporated herein by reference.

FIELD OF THE INVENTION

The present invention relates to systems and methods for producing light. More specifically, the invention relates to systems and methods for dynamically adapting a produced light as a countermeasure to glare as an environmental factor.

BACKGROUND OF THE INVENTION

Current lighting devices often employ digital lighting technologies such as light-emitting diodes (LEDs) that generally feature longer operating lives, cheaper operating costs, and wider color ranges than those of legacy lighting devices such as incandescent lamps and fluorescent lamps. LEDs not only produce light using less energy than legacy lamps, but also feature directional light emission that allows for more effective delivery of light precisely on target. However, two design aspects of digital lighting solutions that are critical particularly for outdoor lamps are minimizing light waste and reducing glare.

Changing ambient light conditions (e.g., seasonal differences, time of day, subjects in motion) can cause lighting device emissions of a given color to be absorbed by the surrounding environment rather than reflected for perception by the user of the lighting device. Such light waste operates counter to the longevity, affordability, and efficiency of digital lighting devices. Advancements in generation of colored light and adaptation to ambient light conditions hold promise for combating light waste.

U.S. patent application Ser. No. 13/775,936 titled Adaptive Light System and Associated Methods discloses a lighting device that dynamically adapts to a changing ambient environment so that more of its produced light is reflected rather than absorbed, increasing efficiency. More specifically, the light adapter may accept a source signal defining a detected color, and may efficiently manipulate two color points generated by primary light sources along with a white color point generated by a high efficacy light source to produce the detected color. However, enhancing some detected colors under certain ambient lighting conditions may result in an increased perception of glare by the user of the lighting device. Glare is commonly categorized as either discomfort glare or disability glare. Disability glare is a scattering of light in the eye of a viewer which is perceived as a luminous veil over the scene, thereby reducing visibility. Discomfort glare is a sensation of annoyance or distraction that does not necessarily impair the visibility of objects. Discomfort glare may not be blinding, but nonetheless may have negative implications, particularly for driving performance and safety.

Discomfort glare is impacted by several factors. Light sources with higher luminous intensities may be perceived as more glaring. Similarly, perceptions of discomfort may increase as ambient lighting illuminance is reduced, and also as glare sources come closer to the line of sight of the viewer. Furthermore, research into spectral power distribution (SPD), which is a quantitative measure of the amount of energy emitted at different wavelengths, suggests that short wavelength light contributes more to the discomfort glare response than do most higher-wavelength lights.

Regarding SPD as a glare-producing factor, different lamps have different spectral characteristics that are often visible to humans (e.g., wavelengths in the range of about 380 to 760 nanometers (nm)). "Warm white" sources, such as incandescent bulbs, emit more strongly at the middle and longer (red) wavelengths. "Cool white" sources, including many LEDs, feature a spectral power distribution favoring short wavelengths (blue and violet). Although LEDs can be made in nearly every visible color, the most efficient formulations are rich in blue light because blue wavelengths activate phosphors which provide the other colors necessary for high quality white light.

Studies suggest that blue-rich white light causes more glare than longer wavelength lights at like illuminances, with later studies confirming a wavelength in the range of 420 nm to 480 nm to be most closely linked with discomfort glare. The same studies determined the least amount of discomfort was seen with a 577 nm stimulus. Generally, a light source with increased spectral output below 500 nm may increase the perception of glare, particularly for older people, and may be more likely to hinder vision than a conventional source of the same intensity. Various approaches to reducing discomfort glare by removing known contributing factors are known in the art.

U.S. Pat. No. 6,450,652 to Karpen discloses doping a motor vehicle windshield with Neodymium Oxide to filter the yellow portion of the spectrum from a driver's perception. Elimination of yellow light may lessen glare and improve contrast of objects during night driving when only artificial illumination is available. However, such a light filter not only fails to adapt to changing ambient light conditions, but also operates to hinder visibility of objects that reflect wavelengths in the fixed spectral region being filtered, both in daylight and at night.

European Patent No. 1,671,059 to Schottland et al. discloses incorporating dyes and design features into the lens for a lamp for the purpose of shifting the chromaticity of the light source. Using such a lens to manipulate an emitted beam may reduce discomfort glare and/or increase brightness to enhance visibility at night to the human eye. However, like the Karpen patent above, the fixed lens design is not equipped to adapt to changing ambient light conditions based on the unique spectral characteristics of various objects passing through the illumination range of the light source.

European Patent Application No. 2,292,464 by Tatara et al. discloses a vehicle headlight system configured to selectively illuminate a region in front of the vehicle with an adaptable illumination pattern. A target object in front of the vehicle is extracted from an image frame, and a light distribution pattern is selected that suppresses glare directed at the target object. However, manipulation of image patterns does nothing to enhance a target object for viewing based on the color of the object, nor to reduce glare produced by light reflected from the target object.

A need exists for a light adapter that may accept a source signal defining a detected color, and that may efficiently manipulate two or more color points generated by primary light sources along with a white color point generated by a high efficacy light source to produce the detected color. Additionally, a lighting device with the ability to adapt to a detected color would be able to dynamically increase its efficiency by allowing for reduced light absorption by the lighting device's environment, but without causing a discomfort glare response at the detected color. More specifically, a need exists for a lighting device with the ability to adapt to its environment so that more of its produced light is reflected rather than absorbed, and simultaneously to counteract discomfort glare contributed to by the produced light. Additionally, such a lighting device may need to adapt multiple times to account for changes in its environment.

This background information is provided to reveal information believed to be of possible relevance to the present invention. No admission is necessarily intended, nor should be construed, that any of the preceding information constitutes prior art against the present invention.

SUMMARY OF THE INVENTION

With the foregoing in mind, embodiments of the present invention are related to methods and systems for advantageously adapting the light emissions of a lighting device both to enhance a color identified in the environment surrounding the lighting device, and to counteract the effects of glare present in that environment. More specifically, color adaption as implemented in the present invention may allow for increased energy efficiency during lighting device operation by tailoring emissions to a detected color that may be reflected back into an illuminable space at a glare discomfort rating at or above a threshold value. The present invention may further allow for less light absorption by the environment, advantageously resulting in greater brightness without less than satisfactory discomfort glare as perceived by a user of the lighting device. The present invention may further allow for mixing of the emissions of two color points plus a white color point to not only achieve a detected color without less than satisfactory discomfort glare but also to minimize power consumption and heat.

These and other objects, features, and advantages according to the present invention are provided by an adaptive anti-glare light system to control a lighting device. The adaptive anti-glare light system may include a sensor and a color selection engine operatively coupled to the sensor. The system may also include a controller operatively coupled to the color selection engine, and a plurality of light sources each configured to emit a source light in a source wavelength range. Each of the plurality of light sources may be operatively coupled to the controller. In some embodiments, at least one of the plurality of light sources is a white light.

The sensor may monitor for a detected color within a desired illumination range. The illumination range may be based on one or more of a constant, a controlled vehicle speed, an ambient light level, a weather condition, a presence of a vehicle, an absence of a vehicle, and a type of roadway. The color selection engine may determine a dominant wavelength of the detected color. The color selection engine may also determine a combination of at least two of the plurality of light sources that emit a combined wavelength that approximately matches the dominant wavelength of the detected color. The controller may determine if the detected color is characterized by a discomfort glare rating below a threshold level that may be a discomfort glare rating of less than 6 on the De Boer scale. The controller also may operate the combination of at least two of the plurality of light sources to emit the combined wavelength at a discomfort rating at or above the threshold value by selecting a new combined wavelength in the range of wavelengths between the combined wavelength and 577 nm. At least one of the plurality of light sources operated in the combination may be the white light. The plurality of light sources may be provided by light emitting diodes (LEDs).

The system may also include a conversion engine that may be coupled to the sensor and may be configured to perform a conversion operation that operates to receive the detected color. The conversion engine also may determine RGB values of the detected color, and may convert the RGB values of the detected color to XYZ tristimulus values.

The color selection engine may define the dominant wavelength of the detected color as a boundary intersect value that may lie within the standardized color space. The boundary intersect value may be collinear with the XYZ tristimulus values of the detected color and with the tristimulus values of a white point such that the boundary intersect value may be closer to the selected color than to the white point.

The color selection engine may identify a subset of colors within the source wavelength ranges of the source lights emitted by the plurality of light sources, such that the subset of colors may combine to match the dominant wavelength of the detected color. The color selection engine also may choose two of the subset of colors to combine to match the dominant wavelength of the detected color. The choice of colors may include a first color value that may be greater than the dominant wavelength of the detected color, and a second value that may be lesser than the dominant wavelength of the detected color. None of the remaining subset of colors may have a source wavelength nearer to the dominant wavelength of the detected color than either of the first color value and the second color value.

In another embodiment, the choice of colors may include a first color value that may be lesser than the dominant wavelength of the detected color. None of the subset of colors may have a source wavelength greater than the first color value, and none of the subset of colors may have a source wavelength lesser than a second color value.

In yet another embodiment, the choice of colors may include a second color value that may be greater than the dominant wavelength of the detected color. None of the subset of colors may have a source wavelength lesser than the second color value, and none of the subset of colors may have a source wavelength greater than a source wavelength of the first color value.

The color selection engine also may define a color line between the XYZ tristimulus values of the detected color and the XYZ tristimulus values of the white point, and also a matching line containing XYZ tristimulus values of the first color and XYZ tristimulus values of the second color. The color selection engine may also identify an intersection point of the color line and the matching line. The color selection engine may also determine a percentage of the first color value and a percentage of the second color value to combine to match the dominant wavelength of the color represented by the intersection point.

A method aspect of the present invention is for adapting a source light as a countermeasure to glare. The method may comprise detecting a light with a discomfort glare rating below a threshold level, and converting the source color signal to a value representing a dominant wavelength of the detected color. The method may further comprise determining a combination of and percentages of the plurality of light sources that may be combined to emit a combined wavelength that approximately matches the detected color. The method may further comprise operating the two or more light sources along with a white light to emit an adapted light that includes the combined wavelength at a discomfort level at or above the threshold level.

BRIEF DESCRIPTION OF THE DRAWINGS

FIG. 3 is an exemplary table illustrating a de Boer discomfort glare rating scale.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Additionally, in the following detailed description, reference may be made to the driving of light emitting diodes, or LEDs. A person of skill in the art will appreciate that the use of LEDs within this disclosure is not intended to be limited to the any specific form of LED, and should be read to apply to light emitting semiconductors in general. Accordingly, skilled artisans should not view the following disclosure as limited to the any particular light emitting semiconductor device, and should read the following disclosure broadly with respect to the same. Also, a person skilled in the art should notice this description may contain other terminology to convey position, orientation, and direction without departing from the principles of the present invention.

Referring now to FIGS. 1-10, an adaptive anti-glare light system and associated methods according to the present invention are now described in greater detail. Throughout this disclosure, the adaptive anti-glare light system may also be referred to as a system or the invention. Alternate references to the adaptive anti-glare light system in this disclosure are not meant to be limiting in any way.

Figure 1:
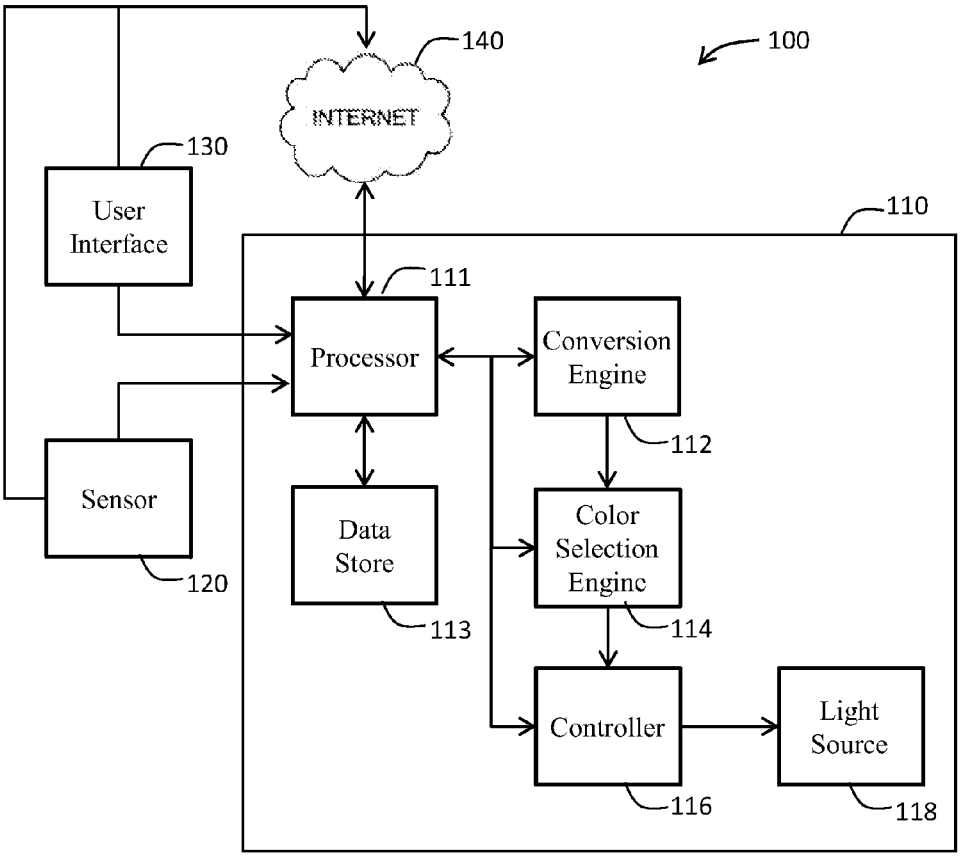
FIG. 1 is a block diagram of an adaptive anti-glare light system according to an embodiment of the present invention.

Referring now to FIG. 1, an adaptive anti-glare light system 100 according to an embodiment of the present invention will now be described in greater detail. The logical components of the light system 100 may comprise a lighting device 110 that may include a conversion engine 112, a color selection engine 114, a controller 116, and a light source 118. For example, and without limitation, the light source 118 may comprise a plurality of LEDs each arranged to generate a source light. A subset of the LEDs in the light source 118 may be arranged to produce a combined light that may exhibit a detected color. The controller 116 may be designed to control the characteristics of the combined light emitted by the light source 118.

A source signal representing the detected color may be conveyed to the lighting device 110 using a color capture device (for example, and without limitation, a sensor 120 and/or a user interface 130 on a remote computing device). More specifically, the color capture device implemented as a sensor 120 may be configured to detect and to transmit to the lighting device 110 color information from the ambient lighting environment that may be located within an illumination range of the light source 118. For example, and without limitation, the sensor 120 may be an environment sensor such as an optical sensor, a color sensor, and a camera. Alternatively or in addition to use of the sensor 120, the user interface 130 on the remote computing device may be configured to convey color information from a user whose visual region of interest may be within an illumination range of the light source 118. For example, and without limitation, the medium for conveyance of color information from the user interface 130 of the remote computing device to the lighting device 110 may be a network 140.

Continuing to refer to FIG. 1, the lighting device 110 may comprise a processor 111 that may accept and execute computerized instructions, and also a data store 113 which may store data and instructions used by the processor 111. More specifically, the processor 111 may be configured to receive the input transmitted from some number of color capture devices 120, 130 and to direct that input to the data store 113 for storage and subsequent retrieval. For example, and without limitation, the processor 111 may be in data communication with the color capture device 120, 130 through a direct connection and/or through the network connection 140.

The conversion engine 112 and the color selection engine 114 may cause the processor 111 to query the data store 113 for color information detected by the color capture device 120, 130, and may interpret that information to identify color points within the lighting capability of the light source 118 that may be used advantageously to enhance the detected color in the environment. More specifically, the conversion engine 112 may perform a conversion operation to convert the source signal to a format that may facilitate a comparison by the selection engine 114 of the detected color to spectral capabilities supported by the light source 118. The controller 116 may cause the processor 111 to query the data store 113 for supported color points identified to enhance the detected color without causing discomfort glare at the wavelength of the detected color, and may use this retrieved information to generate signals directing the tuning of the spectral output of the light source 118. For example, and without limitation, the controller 116 may generate output signals that may be used to drive the plurality of LEDs in the light source 118.

Figure 2A:
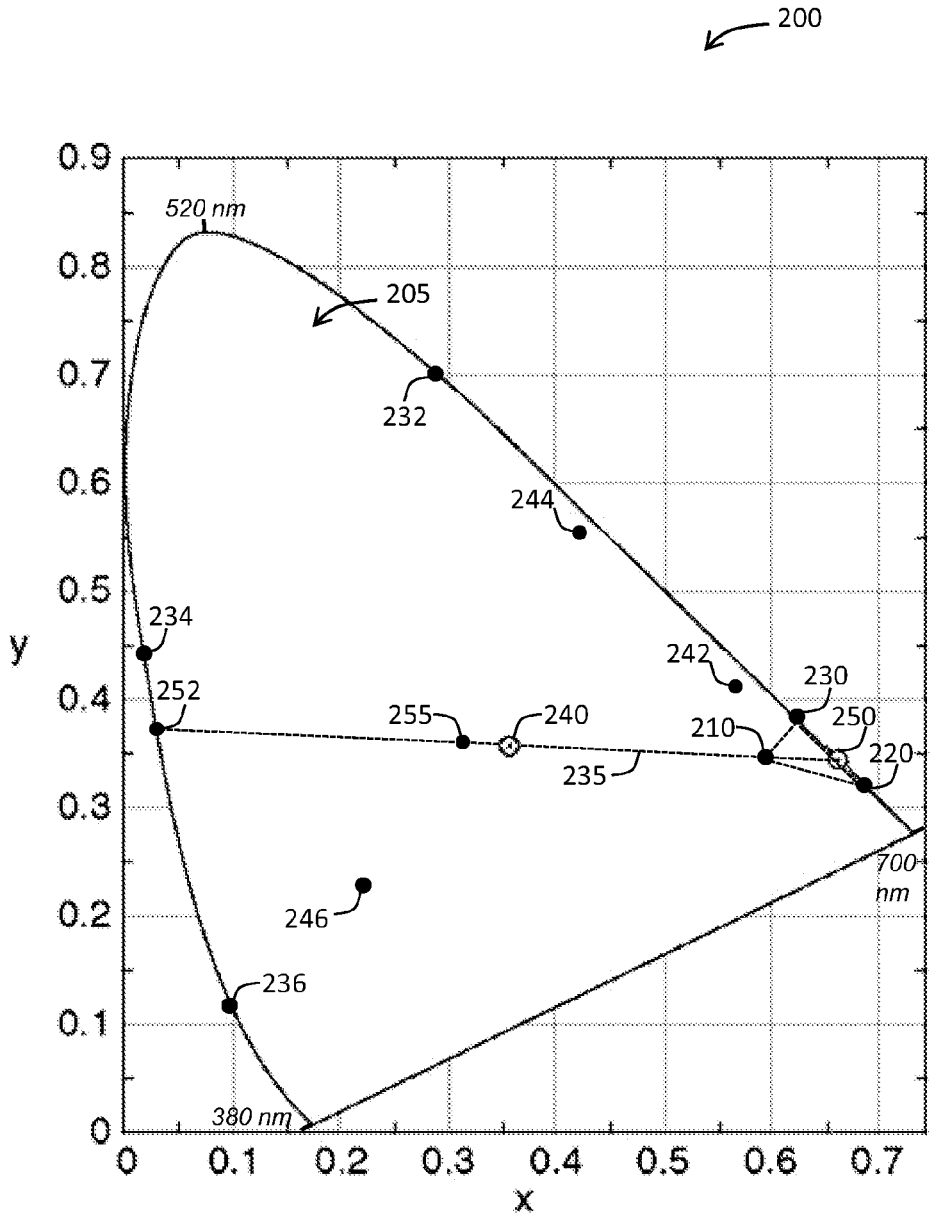
FIG. 2A is an exemplary graph illustrating CIE 1931 color coordinates for color point selection variables.

Referring now to graph 200 of FIG. 2A, for purposes of definition, the CIE 1931 XYZ color space, created by International Commission on Illumination, is a red-green-blue (RGB) color space that may be characterized by in three dimensions by tristimulus values which represent the luminance and chromaticity of a color (incorporated herein by reference). The chromaticity of a color alternatively may be specified in two dimensions by two derived parameters x and y, defined as two of three normalized values that are functions of the three tristimulus values, shown as X, Y, and Z in Expression A below.

$$x = \frac{X}{X+Y+Z} \qquad \text{Expression A}$$

$$y = \frac{Y}{X+Y+Z}$$

$$z = \frac{Z}{X+Y+Z} = 1 - x - y$$

The derived color space specified by x, y, and Y is known as the CIE xyY color space. To return to a three-dimensional representation, the X and Z tristimulus values may be calculated from the chromaticity values x and y and the Y tristimulus value as shown below in Expression B.

$$X - \frac{Y}{y}x \qquad \text{Expression B}$$

$$Z = \frac{Y}{y}(1 - x - y)$$

Referring now to table 300 of FIG. 3, for purposes of definition, the de Boer rating scale has been used by practitioners in the art since the 1960s to subjectively evaluate discomfort glare experienced by viewers of lighted subjects in a given environment. Viewers rate the glare impression on a nine-point scale for which only the odd numbers have qualifiers. Higher ratings 301 (e.g., 7=satisfactory) signify less discomfort glare response than lower ratings 302 (e.g., 1=unbearable). The present disclosure may discuss the adaptive anti-glare light system 100 of the present invention as monitoring factors that contribute to discomfort glare such as light source luminance, light source spectral power distribution (SPD), ambient lighting illuminance, and/or viewer's line of sight as input to determining a threshold value at which glare countermeasures may be directed by the controller 116. However, a person of skill in the art also will appreciate that additional glare-related factors are intended to be included within the scope and spirit of the present invention.

Referring now to flowchart 400 of FIG. 4 and also to graph 200 of FIG. 2A, a method of adapting to a detected color by altering the emission characteristics of the lighting device 110 in response to detection of color in the ambient environment will now be described in detail. Beginning at Block 405, a capture device 120, 130 may monitor light reflected toward the lighting device 110 within a specified illumination range (Block 410). For example, and without limitation, the illumination range may be based on a constant, a controlled vehicle speed, an ambient light level, a weather condition, a presence of another vehicle, an absence of another vehicle, and/or a type of roadway. At Block 420, the color capture device 120, 130 may detect a color within the reflected light to which the emissions of the lighting device 110 may be adapted. For example, and without limitation, the color capture device 120, 130 may codify a source color signal designating RGB values of the detected color, and may transmit that signal to the subsystems of the lighting device 110 for further processing.

The conversion engine 112 may convert the RGB values of the detected color to the XYZ tristimulus values 210 of the detected color at Block 430. The color selection engine 114 may use the XYZ tristimulus values 210 of the detected color to determine a dominant wavelength 250 of the detected color (Block 440), measured in nanometers (nm). A skilled artisan will recognize that RGB values are representative of additive color mixing with primary colors of red, green, and blue over a transmitted light. The present disclosure may discuss the adaptive anti-glare light system 100 of the present invention as converting the detected color, which may be defined in the RGB color space, into a signal generated by the controller 116 comprising three numbers independent of their spectral compositions, that may be defined as XYZ tristimulus values 210. However, a person of skill in the art also will appreciate that additional conversions are intended to be included within the scope and spirit of the present invention. A skilled artisan also will appreciate conversion operations may involve converting the detected color into an output signal to drive light emitting devices in the light source 118.

Figure 4:
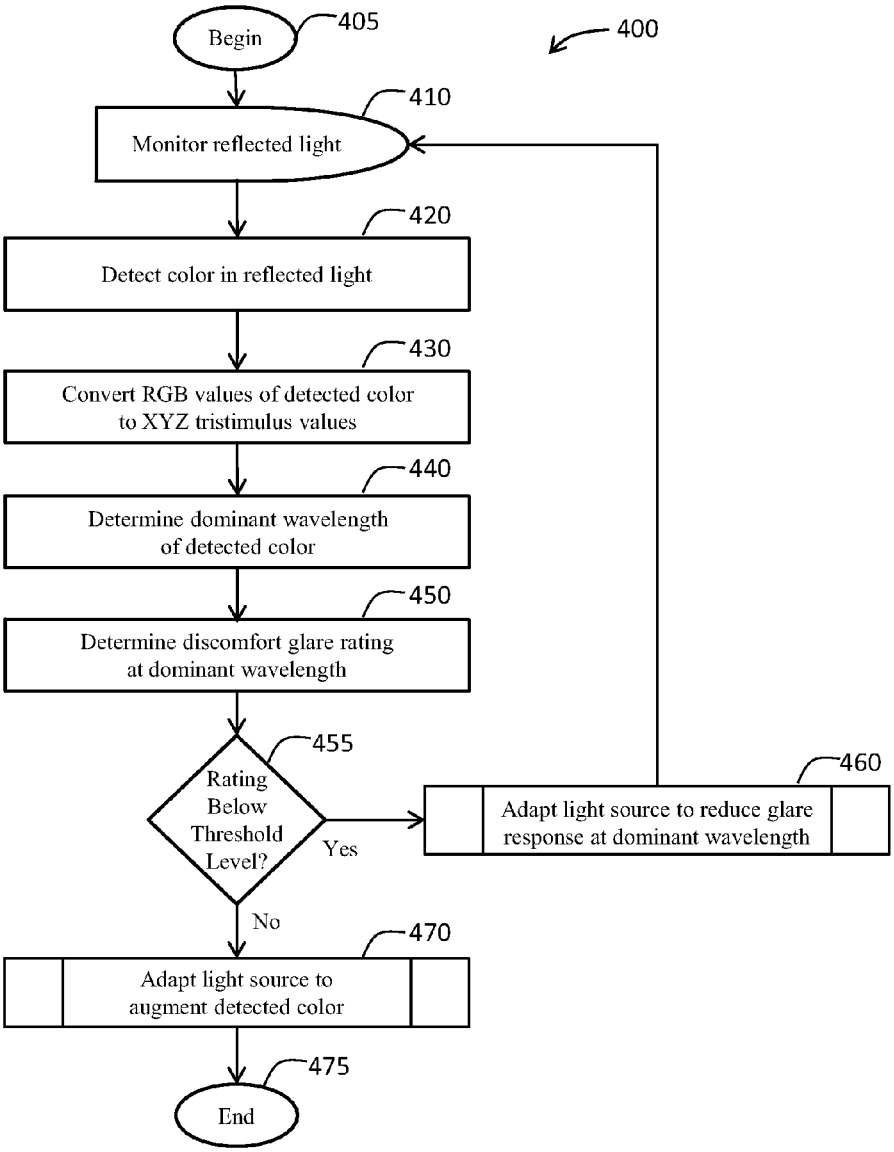
FIG. 4 is a flowchart illustrating a process of adapting light emissions to a detected color using color points emitted by the adaptive anti-glare light system of FIG. 1.

Continuing to refer to FIG. 4, at Block 450 the color selection engine 114 may determine a discomfort glare rating for the dominant wavelength of the detected color. For example, and without limitation, the Schmidt-Clausen and Bindels formula of Expression C below may be applied to calculate a de Boer rating based on the position of a light source, the luminance of the background, and the illuminance of the glare source.

$$W = 5.0 - 2.0\mathrm{LOG}_{10}\frac{E\ \max}{0.003*\left(1+\sqrt{\frac{La}{0.04}}\right)*\theta_{max}^{0.46}} \qquad \text{Expression C}$$

In the above Expression C, W=the mean value on the de Boer scale, E=the average level of illumination directed towards an observer's eye from the light source (lux), θmax=the glare angle between the observer's line of sight and the light source at a location where maximum illumination occurs (minutes), and La=the adaptation illuminance (cd/m2). A person of skill in the art will appreciate that additional formulas for computing a glare rating are intended to be included within the scope and spirit of the present invention.

At Block 455, the color selection engine 114 determines whether the discomfort glare rating of reflected light at the dominant wavelength is above or below a threshold level. Referring again to FIG. 3, higher ratings on the de Boer scale 300 signify lesser glare, and lower ratings signify greater glare. For example, and without limitation, the threshold may be set at a de Boer glare rating of 6 to signify the level below which visual response due to the impact of glare may become less than satisfactory 301 to a viewer.

Continuing to refer to FIG. 4, if at Block 455 the discomfort glare rating is found to be below the threshold level, the controller 116 may use information about the characteristics of the reflected light to manipulate the light source 118 to reduce glare resulting at the dominant wavelength (Block 460). Manipulations of the light source 118 may then be measured for successful glare reduction by returning to Block 410, where monitoring of newly reflected light may continue. Alternatively, if at Block 455 the discomfort glare rating is found to be above the threshold level, the controller 116 may use information about the characteristics of the reflected light to adapt the light source 118 to augment the detected color for enhanced viewing (Block 470). The process 400 of matching a detected color using color points of an adaptable light source 118 ends at Block 475. Both the glare reduction and color augmentation processes described above will be discussed in greater detail below.

Figure 5A:
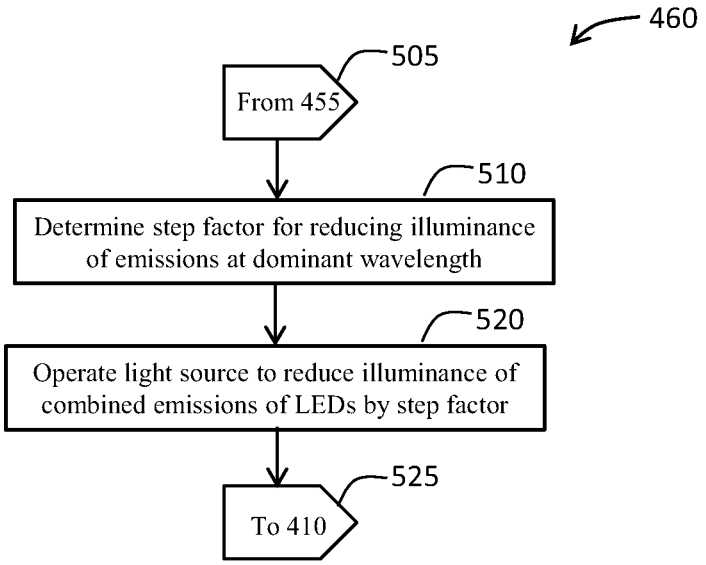
FIGS. 5A and 5B are flowcharts illustrating respective embodiments of processes of controlling the adaptive anti-glare light system of FIG. 1 to reduce glare response at a dominant wavelength of the detected color as mentioned in the process described in FIG. 4.
Figure 5B:
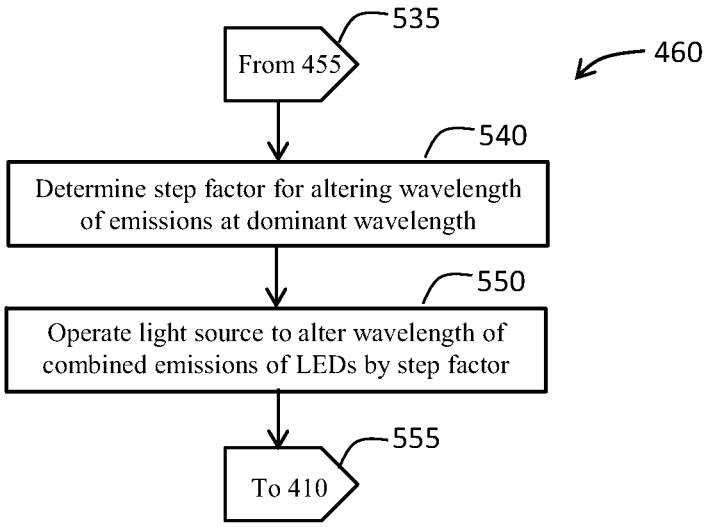

Referring now to FIGS. 5A and 5B, and continuing to refer to graph 200 of FIG. 2A, exemplary methods by which the color selection engine 114 and the controller 116 may operate to adapt the light source 118 to reduce glare at the dominant wavelength of the detected color will now be described in detail. For example, and without limitation, in FIG. 5A at Block 510 the color selection engine 114 may compare an illuminance of the detected color against a step factor by which the illuminance may be reduced to counteract discomfort glare. More specifically, the color selection engine 114 may use the processor 111 to query the data store 113 for the appropriate step factor, defined as step factor i, to be applied for reducing a glare-producing illuminance. At Block 520, the controller 116 may identify one or more LEDs within the light source 118 that are actively emitting light, and may control those LEDs to emit at a luminance reduced by the step factor i.

Alternatively, and similarly for example and without limitation, in FIG. 5B at Block 540 the color selection engine 114 may compare the dominant wavelength of the detected color against a step factor by which the emissions of the light source 118 may be altered to counteract discomfort glare. More specifically, the color selection engine 114 may use the processor 111 to query the data store 113 for the appropriate step factor, defined as step factor $\lambda$, to be applied for changing from a wavelength known to increase discomfort glare. At Block 550, the controller 116 may identify one or more LEDs within the light source 118 that are actively emitting light, and may control those LEDs to emit at a wavelength closer by the step factor $\lambda$ to a less-glaring target wavelength (for example, 577 nm). The glare reduction implementations described above are provided as examples, and are not meant to be limiting in any way.

Figure 6:
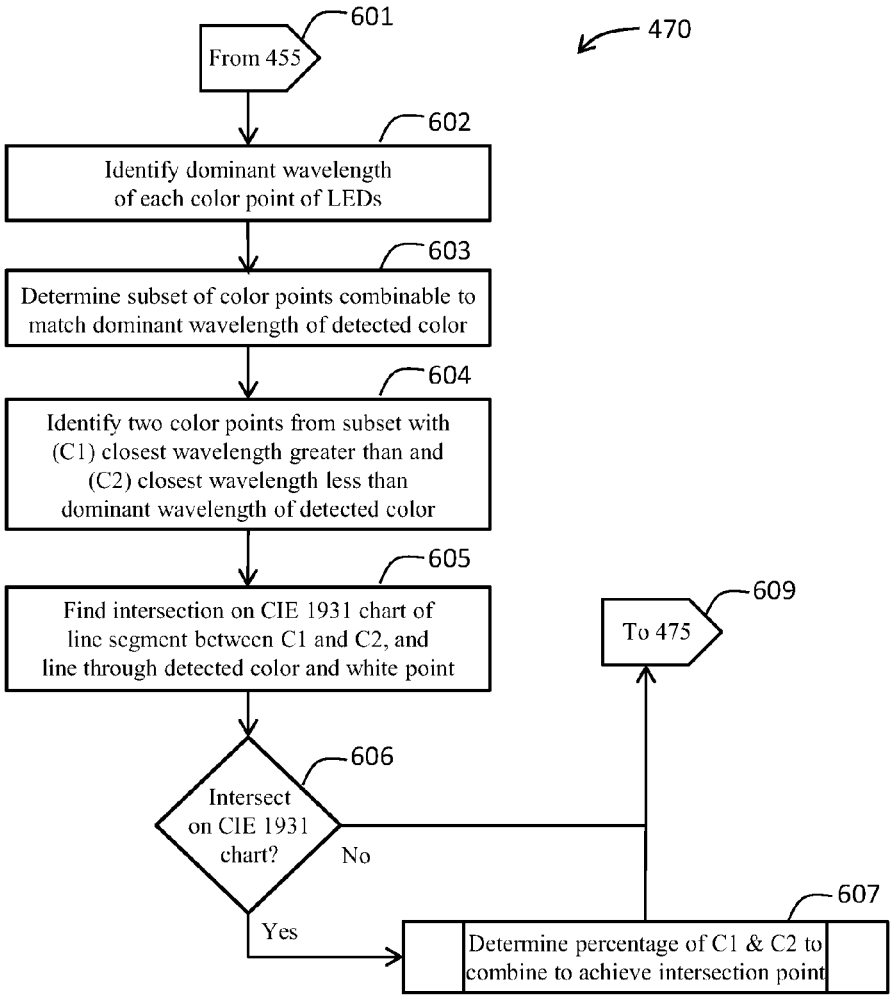
FIG. 6 is a flowchart illustrating a process of controlling the adaptive anti-glare light system of FIG. 1 to augment the detected color as mentioned in the process described in FIG. 4.

Referring now to FIG. 6, and continuing to refer to graph 200 of FIG. 2A, exemplary methods by which the color selection engine 114 and the controller 116 may operate to adapt the light source 118 to augment the detected color for enhanced viewing will now be described in detail. Additional details regarding matching a selected color using adaptive color points emitted by an adaptive anti-glare light system 100 are found below, but can also be found in U.S. Provisional Patent Application No. 61/643,316 entitled LUMINAIRE HAVING AN ADAPTABLE LIGHT SOURCE AND ASSOCIATED METHODS filed on May 6, 2012, as well as U.S. patent application Ser. No. 13/775,936 titled *Adaptive Light System and Associated Methods*, filed Feb. 25, 2013, the entire contents of each of which are incorporated herein by reference.

At Block 602, the dominant wavelength of each color point of the LEDs in the light source 118 may be determined by the color selection engine 114. The method then includes a step of the color selection engine 114 determining a subset of colors emitted by the light source 118 that may be combined to match the dominant wavelength of the detected color (Block 603). From that subset, two light colors emitted by the monochromatic LEDs with wavelengths closest to the detected color's dominant wavelength may be paired. For example, and without limitation, one of the pair of combinable monochromatic colors 220 may have a wavelength greater than the detected color's dominant wavelength, while the other combinable monochromatic color 230 may have a wavelength less than the detected color's dominant wavelength (Block 604).

A skilled artisan may recognize that the dominant wavelength may be found by plotting the detected color 210 on a CIE 1931 color chart 200, and drawing a line 235 through the detected color 210 and a reference white point 240. The boundary intersection 250 of the line 235 that is closer to the detected color 210 may be defined as the dominant wavelength, while the boundary intersection 252 of the line 235 that is closer to the white point 240 may be defined as the complementary wavelength.

Figure 2B:
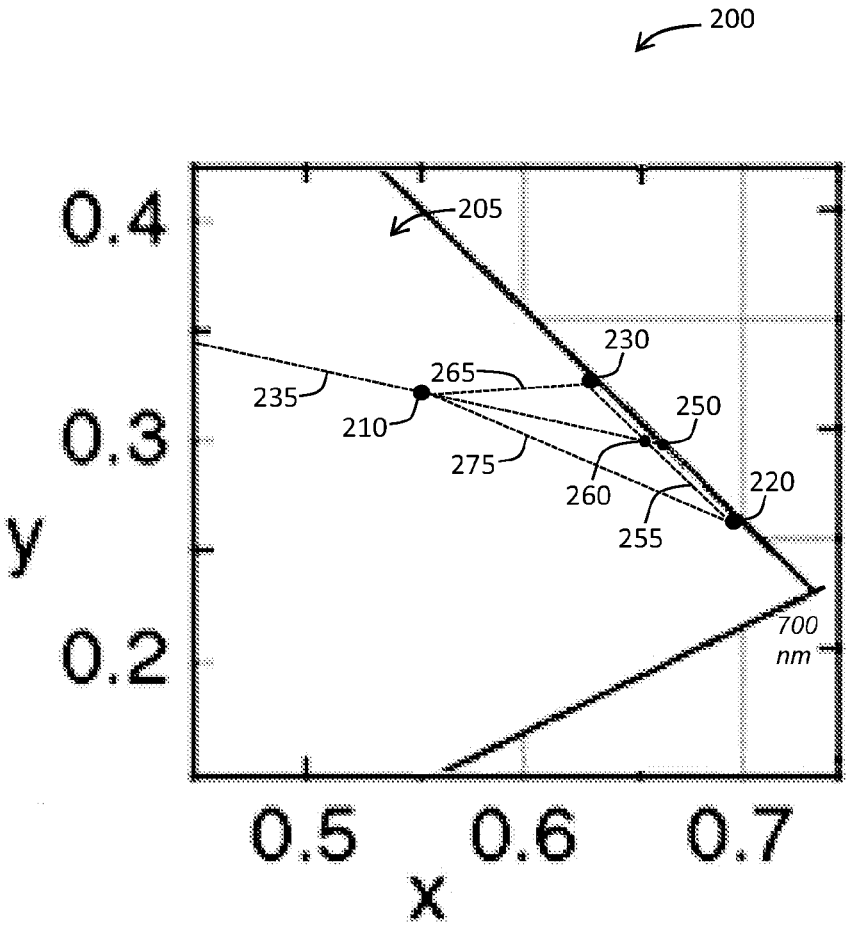
FIG. 2B is a magnified illustration of an area of the graph of FIG. 2A.

Referring additionally to the magnified area of FIG. 2A illustrated in FIG. 2B, the closest-wavelength color points 220, 230 may be added to the color chart 200 with a line 255 drawn between them (Block 605). At Block 606, line 235 and line 255 may be checked for an intersection 260 on the CIE 1931 color chart 200. If no such intersection occurs within the CIE 1931 color space 205, then no color point match may exist with the monochromatic color points 220, 230 having the closest wavelengths. In this instance, the color selection engine 114 may discard the results, after which the process may end at Block 609. If, however, such an intersection does occur on the CIE 1931 color chart 200 at Block 606, the intersection point 260 may be used by the color selection engine 114 to determine the percentage of each of the two adaptable light color points 220, 230 needed to produce the color represented by the intersection point 260 (Block 607). This determination will be discussed in greater detail below. The process 600 of matching a selected color using color points of an adaptable light source 118 ends at Block 609.

Referring to flowchart 607 of FIG. 7 and continuing to refer to graph 200 of FIGS. 2A and 2B, the method by which the color selection engine 114 determines the percentage of each of two color points 220, 230 of an adaptable light source 118 needed to generate the intersection color point 260 will now be described in greater detail. Starting at Block 705, the ratio of the two adaptable light color points 220, 230 may be calculated (Block 710). The ratio is given below in Expression 1.

$$\frac{\left(\frac{l}{w}\right)_1 * |p_s\ p_2|}{\left(\frac{l}{w}\right)_2 * |p_s - p_1|} = \frac{r_1}{r_2} \quad \text{Expression 1}$$

In the above Expression 1, $$\left(\frac{l}{w}\right)_1 =$$

luminous efficacy in lumens per watt of the first adaptable light color point 220, $$\left(\frac{l}{w}\right)_2 =$$

luminous efficacy in lumens per watt of the second adaptable light color point 230, $|p_s - p_2|$=the distance 265 between the detected color point 210 and the second adaptable light color point 230, $|p_0 - p_1|$=the distance 275 between the detected color point 210 and the first adaptable light color point 220, and $r_1/r_2$=the ratio of the two adaptable light colors 220, 230 to be mixed to create a combined monochromatic color point characterized by the x and y coordinates of intersection point 260. This ratio may then be scaled to 100% (Block 720). In other words, $r_1$ and $r_2$ may be multiplied by some number such that greater of the scaled ratio terms $R_1$ and $R_2$ (representing the first color point 220 and the second color point 230, respectively), equals 100.

Figure 7:
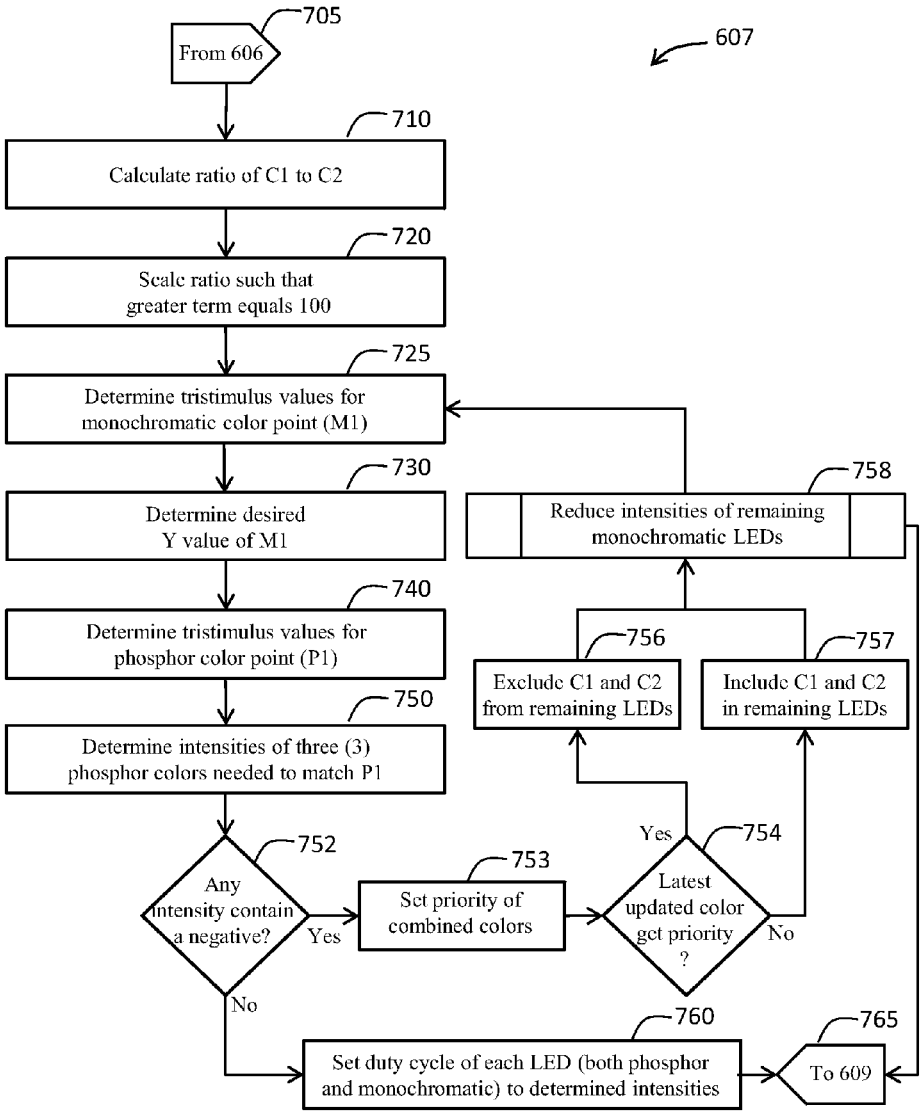
FIG. 7 is a flowchart illustrating a process of determining percentages of color points emitted by the adaptive anti-glare light system of FIG. 1 to combine to match the detected color as mentioned in the process described in FIG. 6.

Continuing to refer to FIG. 7, the combined monochromatic color point 260 may be defined as the summation of all monochromatic colors in the spectral output of the light source 118 including, for example, and without limitation, the first adaptable color point 220, the second adaptable color point 230, and all remaining monochromatic colors 232, 234, 236. The tristimulus values of the combined monochromatic color point 260 (and, consequently, the xyY point in the CIE 1931 color space 205) may be determined at Block 725. The desired Y value, also known in the art as intensity, of the combined monochromatic color point 260 may be determined at Block 730 using Expression 2 below.

$$Y = R_1 Y_1 + R_2 Y_2 \quad \text{Expression 2}$$

In the above Expression 2, $Y_1$=the Y value of the first adaptable light color point 220, and $Y_2$=the Y value of the second adaptable light color point 230. The resultant intensity of the combined monochromatic color point 260 may be expressed on a scale from 0 percent to 100 percent, where 100 percent ($Y_{max}$) represents the maximum lumen output that the combined monochromatic color point 260 may provide.

After the intensity of the combined monochromatic color point 260 is calculated at Block 730, the tristimulus value for a phosphor color point 255 may be determined at Block 740 by subtracting the xyY value of the detected color point 210 from the xyY value of the white point 240. At Block 750, the intensities of the three phosphor light color points 242, 244, 246 needed to achieve the phosphor color point 255 may be determined by applying an inverted tristimulus matrix containing the tristimulus values of the three phosphor color points 242, 244, 246 multiplied by the tristimulus values of the phosphor color point 255.

If none of the calculated intensity results is determined at Block 752 to contain negative values for the monochromatic light color point 260 (from Block 725) nor for any of the phosphor light color points 242, 244, 246 (from Block 750), then the lowest power load result may be identified as that combination of monochromatic and phosphor color points 260, 242, 244, 246 having the lowest sum of intensities. The result with the lowest sum of intensities, and therefore the least amount of power, may be advantageous in terms of increased efficiency of operation of the lighting device 100. At Block 760, the duty cycle of each monochromatic 220, 230, 232, 234, 236 and phosphor 242, 244, 246 LED may be set by the controller 116 to the intensity determined for each in Block 760, after which the process ends at Block 765.

Continuing to refer to FIG. 7, if any of the calculated intensity results are determined at Block 752 to contain negative values for the monochromatic light color point 260 (from Block 725) or for any of the phosphor light color points 242, 244, 246 (from Block 750), then those results may be discarded from consideration for driving the adaptable light source 118 because, as a skilled artisan will readily appreciate having had the benefit of this disclosure, a negative intensity would imply the removal of a light color, which is inefficient because it requires filtering of an emitted color from the light source 118.

Upon detection of negative intensity results, the color selection engine 114 may initiate recalculation of all color point intensities by changing the priority of the combined colors (Block 753). If, at Block 754, the latest combined color is determined to have been given priority over other combined colors, then the monochromatic LEDs having the first and second adaptable colors 220, 230 in their spectral outputs are omitted from consideration for intensity reduction (Block 756). Alternatively, if the latest combined color is determined at Block 754 not to have been given priority over other combined colors, then the monochromatic LEDs having the first and second adaptable colors 220, 230 in their spectral outputs are included in consideration for intensity reduction at Block 757. Calculation of reductions in the output intensities of all monochromatic LEDs remaining after completion of the steps at either Block 756 or Block 757 may take place at Block 758. This intensity reduction process is described in greater detail in flowchart 458 of FIG. 5 in U.S. patent application Ser. No. 13/775,936 titled Adaptive Light System and Associated Methods, filed Feb. 25, 2013, the entire contents of which are incorporated herein by reference. The color selection engine 114 may use the updated intensities from Block 758 to repeat attempts to determine the percentage of the color points 220, 230 starting at Block 725. After a limited number of recalculation attempts at Block 758, the process may end at Block 765.

Another embodiment of the adaptive anti-glare light system 100 of the present invention also advantageously includes a controller 116 positioned in communication with a network 140 (e.g., Internet) in order to receive signals to adapt the light source 118. Additional details regarding communication of signals to the adaptive anti-glare light system 100 are found below, but can also be found in U.S. Provisional Patent Application Ser. No. 61/486,314 entitled Wireless Lighting Device and Associated Methods, as well as U.S. patent application Ser. No. 13/463,020 entitled Wireless Pairing System and Associated Methods and U.S. patent application Ser. No. 13/269,222 entitled Wavelength Sensing Light Emitting Semiconductor and Associated Methods, the entire contents of each of which are incorporated herein by reference.

There exist many exemplary uses for the adaptive anti-glare light system 100 according to an embodiment of the present invention. For example, in a case where advantageous reflection a detected color into an illuminable space is desired (e.g., a color of a particular flower at a florist, a display in a store), the light source 118 of the light system 100 according to an embodiment of the present invention may be readily adapted to emit a light having a particular wavelength suitable for enhancing the detected color without causing discomfort glare.

Figure 8:
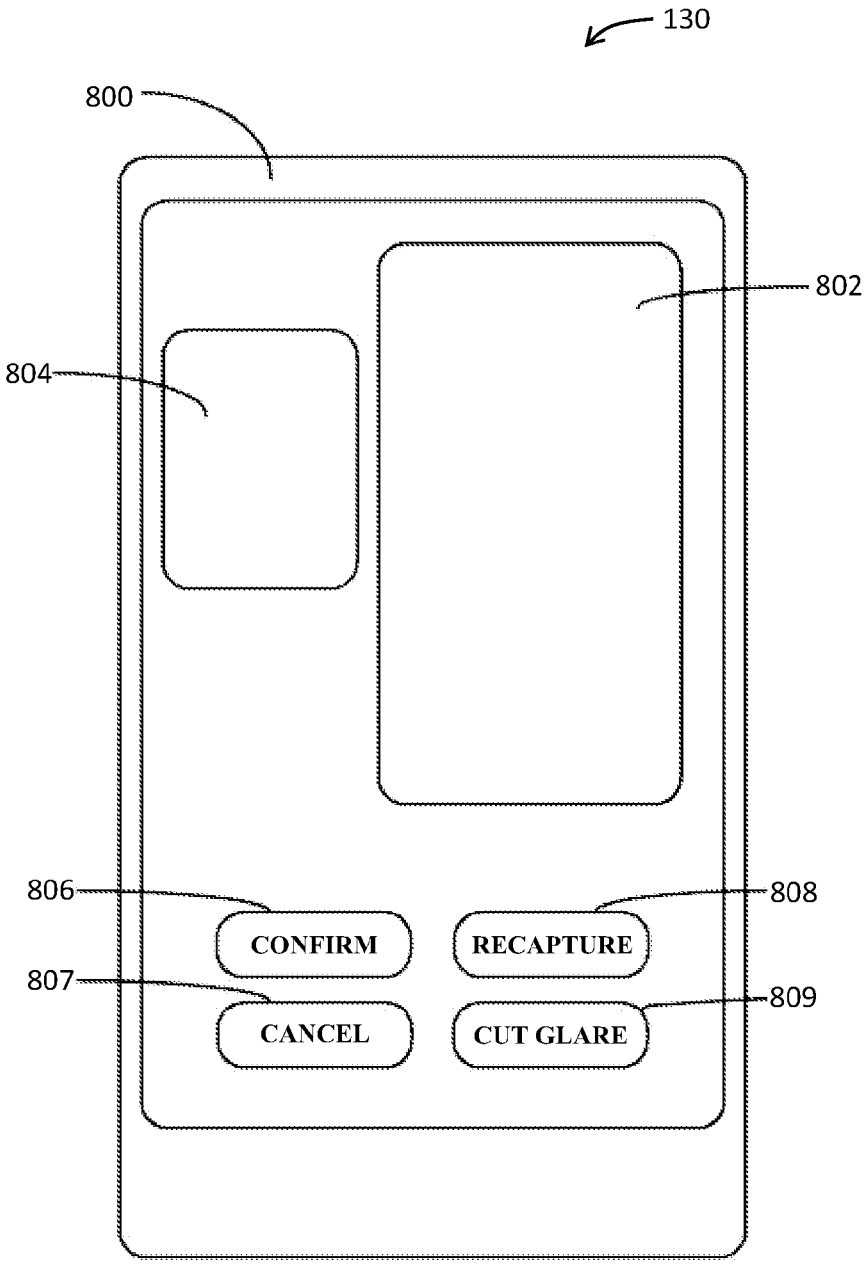
FIG. 8 is a schematic diagram of an exemplary user interface to be used in connection with the adaptive anti-glare light system of FIG. 1.

Referring now to FIG. 8, an exemplary user interface 130 will be discussed. The user interface 130 may be provided by a handheld device 800, such as, for example, any mobile device, or other network connectable device, which may display a picture 802 having a detected color therein. Once a picture has been taken by a user, the detected color 210 may be displayed, with the option for the user to confirm that the detected color is a desired color. The user may confirm this choice by selecting a confirm button 806. The user may also recapture the image from which environmental color adaptation is desired using a recapture button 808, or may cancel the adaptation operation using a cancel button 807. In the event that the user perceives glare in a detected color 210, the user may manually initiate the glare reduction process (as described above) by using the "cut glare" button 809. Those skilled in the art will appreciate that this is but one embodiment of a user interface 130 that may be used. It is contemplated, for example, that the user interface 130 may not include a picture of the color 802 and may, instead, simply send a signal to adapt the light source 118 of the lighting device 110 to a emit a wavelength to enhance particular colors without causing glare. For example, and without limitation, the user may be enabled to select a wavelength to enhance yellows in general. Further, it is contemplated that the user interface 130 may be provided by an application that is downloadable and installable on a mobile phone and over a mobile phone (or other handheld device) network.

Figure 9:
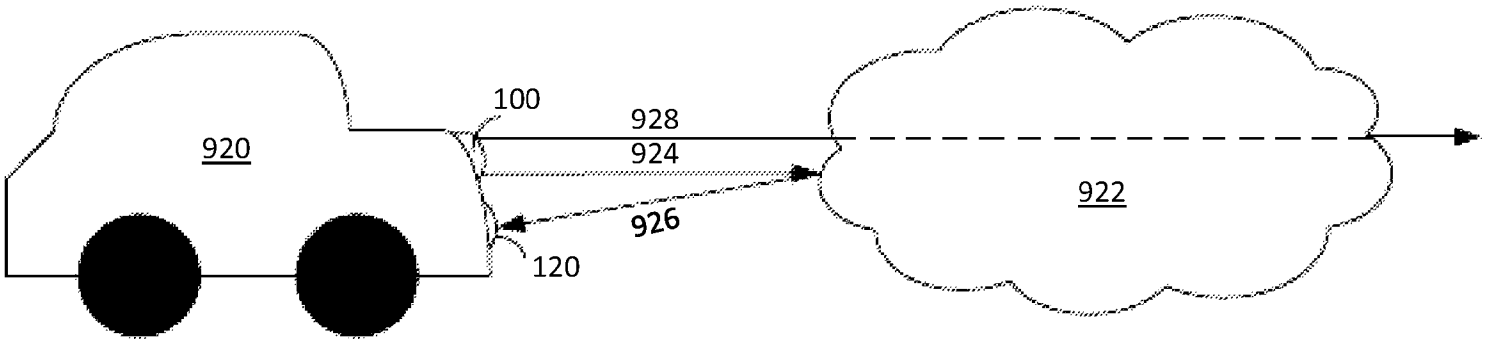
FIG. 9 is a schematic diagram of an adaptive anti-glare light system according to an embodiment of the present invention in use in an automobile.

Referring now to FIG. 9, the adaptive anti-glare light system 100 of the present invention is shown in use in an automobile 920. The adaptive light system 100 may emit a source light 924 during normal operation, and may be switched to emit an adapted light 928 either automatically in the presence of fog 922 or other obstructing environment, or manually by a user. In such an embodiment, it is contemplated that the adaptive anti-glare light system 100 may include a sensor 120, or may be positioned in communication with a sensor 120. The sensor 120 may, for example, be an optical sensor, that is capable of sensing environmental conditions that may obstruct a view of a driver. Fog 922, for example, may pose a danger during driving by obstructing the view of the driver. If the sensor 120 detects reflected light 926 which has failed to permeate the fog 922, the sensor may be able to choose an appropriate adapted light 928 which may allow the user to see through the fog 922 more clearly. It is contemplated that such an application may be used in an automatic sense, i.e., upon sensing the environmental condition, the light source 118 on the lighting device 110 may be dynamically adapted to emit a wavelength that alters glaring colors and enhances other colors so that the path before the driver is more readily visible. The uses described above are provided as examples, and are not meant to be limiting in any way.

Figure 10:
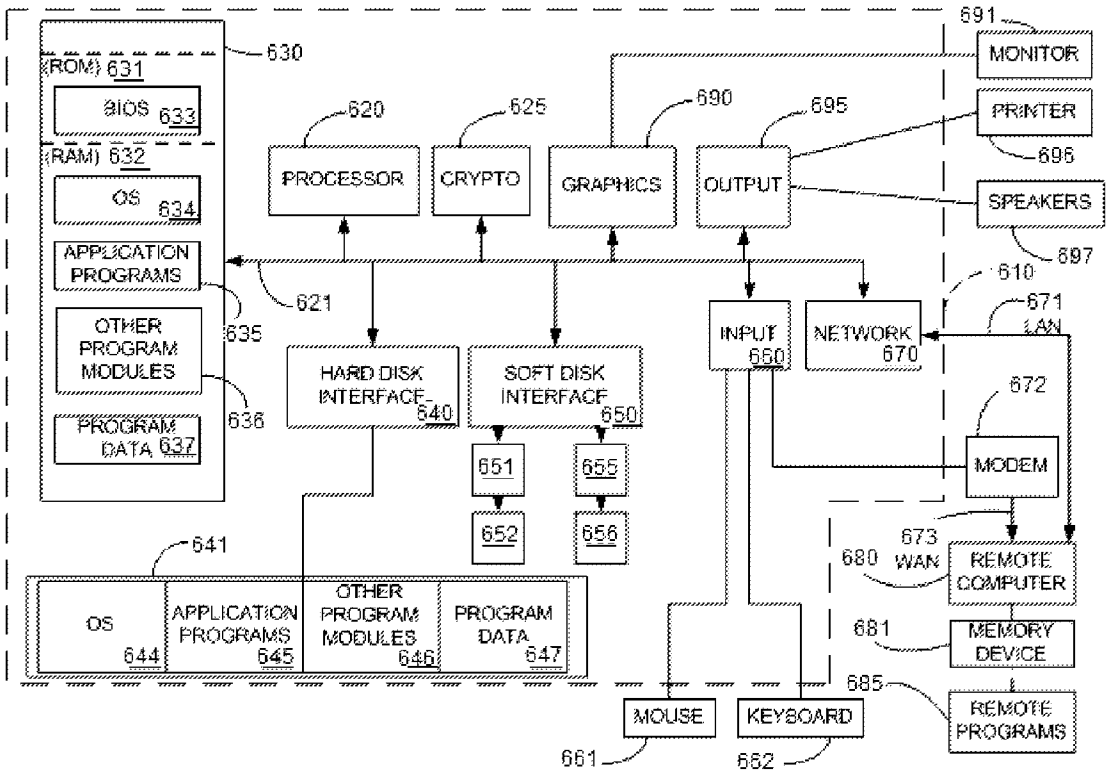
FIG. 10 is a block diagram representation of a machine in the example form of a computer system according to an embodiment of the present invention.

A skilled artisan will note that one or more of the aspects of the present invention may be performed on a computing device. The skilled artisan will also note that a computing device may be understood to be any device having a processor, memory unit, input, and output. This may include, but is not intended to be limited to, cellular phones, smart phones, tablet computers, laptop computers, desktop computers, personal digital assistants, etc. FIG. 10 illustrates a model computing device in the form of a computer 610, which is capable of performing one or more computer-implemented steps in practicing the method aspects of the present invention. Components of the computer 610 may include, but are not limited to, a processing unit 620, a system memory 630, and a system bus 621 that couples various system components including the system memory to the processing unit 620. The system bus 621 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI).

The computer 610 may also include a cryptographic unit 625. Briefly, the cryptographic unit 625 has a calculation function that may be used to verify digital signatures, calculate hashes, digitally sign hash values, and encrypt or decrypt data. The cryptographic unit 625 may also have a protected memory for storing keys and other secret data. In other embodiments, the functions of the cryptographic unit may be instantiated in software and run via the operating system.

A computer 610 typically includes a variety of computer readable media. Computer readable media can be any available media that can be accessed by a computer 610 and includes both volatile and nonvolatile media, removable and non-removable media. By way of example, and not limitation, computer readable media may include computer storage media and communication media. Computer storage media includes volatile and nonvolatile, removable and non-removable media implemented in any method or technology for storage of information such as computer readable instructions, data structures, program modules or other data. Computer storage media includes, but is not limited to, RAM, ROM, EEPROM, FLASH memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer 610. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Combinations of any of the above should also be included within the scope of computer readable media.

The system memory 630 includes computer storage media in the form of volatile and/or nonvolatile memory such as read only memory (ROM) 631 and random access memory (RAM) 632. A basic input/output system 633 (BIOS), containing the basic routines that help to transfer information between elements within computer 610, such as during start-up, is typically stored in ROM 631. RAM 632 typically contains data and/or program modules that are immediately accessible to and/or presently being operated on by processing unit 620. By way of example, and not limitation, FIG. 10 illustrates an operating system (OS) 634, application programs 635, other program modules 636, and program data 637.

The computer 610 may also include other removable/non-removable, volatile/nonvolatile computer storage media. By way of example only, FIG. 10 illustrates a hard disk drive 641 that reads from or writes to non-removable, nonvolatile magnetic media, a magnetic disk drive 651 that reads from or writes to a removable, nonvolatile magnetic disk 652, and an optical disk drive 655 that reads from or writes to a removable, nonvolatile optical disk 656 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 641 is typically connected to the system bus 621 through a non-removable memory interface such as interface 640, and magnetic disk drive 651 and optical disk drive 655 are typically connected to the system bus 621 by a removable memory interface, such as interface 650.

The drives and their associated computer storage media discussed above and illustrated in FIG. 10 provide storage of computer readable instructions, data structures, program modules and other data for the computer 610. In FIG. 10, for example, hard disk drive 641 is illustrated as storing an OS 644, application programs 645, other program modules 646, and program data 647. Note that these components can either be the same as or different from OS 633, application programs 633, other program modules 636, and program data 637. The OS 644, application programs 645, other program modules 646, and program data 647 are given different numbers here to illustrate that, at a minimum, they may be different copies. A user may enter commands and information into the computer 610 through input devices such as a keyboard 662 and cursor control device 661, commonly referred to as a mouse, trackball or touch pad. Other input devices (not shown) may include a microphone, joystick, game pad, satellite dish, scanner, or the like. These and other input devices are often connected to the processing unit 620 through a user input interface 660 that is coupled to the system bus, but may be connected by other interface and bus structures, such as a parallel port, game port or a universal serial bus (USB). A monitor 691 or other type of display device is also connected to the system bus 621 via an interface, such as a graphics controller 690. In addition to the monitor, computers may also include other peripheral output devices such as speakers 697 and printer 696, which may be connected through an output peripheral interface 695.

The computer 610 may operate in a networked environment using logical connections to one or more remote computers, such as a remote computer 680. The remote computer 680 may be a personal computer, a server, a router, a network PC, a peer device or other common network node, and typically includes many or all of the elements described above relative to the computer 610, although only a memory storage device 681 has been illustrated in FIG. 10. The logical connections depicted in FIG. 10 include a local area network (LAN) 671 and a wide area network (WAN) 673, but may also include other networks 140. Such networking environments are commonplace in offices, enterprise-wide computer networks, intranets and the Internet.

When used in a LAN networking environment, the computer 610 is connected to the LAN 671 through a network interface or adapter 670. When used in a WAN networking environment, the computer 610 typically includes a modem 672 or other means for establishing communications over the WAN 673, such as the Internet. The modem 672, which may be internal or external, may be connected to the system bus 621 via the user input interface 660, or other appropriate mechanism. In a networked environment, program modules depicted relative to the computer 610, or portions thereof, may be stored in the remote memory storage device. By way of example, and not limitation, FIG. 10 illustrates remote application programs 685 as residing on memory device 681.

The communications connections 670 and 672 allow the device to communicate with other devices. The communications connections 670 and 672 are an example of communication media. The communication media typically embodies computer readable instructions, data structures, program modules or other data in a modulated data signal such as a carrier wave or other transport mechanism and includes any information delivery media. A "modulated data signal" may be a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Computer readable media may include both storage media and communication media.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A method of adapting light to environmental conditions as a countermeasure to glare using a lighting device that includes a sensor, a color selection engine operatively coupled to the sensor, a controller operatively coupled to the color selection engine, and a plurality of light sources each configured to emit a source light in a source wavelength range, wherein each of the plurality of light sources is operatively coupled to the controller, wherein at least one of the plurality of light sources is a white light, the method comprising:

emitting a first light;

receiving a reflected light comprising a detected color;

determining if the detected color is characterized by a discomfort glare rating below a threshold level;

determining a dominant wavelength of the detected color that is characterized by the discomfort glare rating of the detected color being below the threshold value;

determining a combination of at least two of the plurality of light sources that emit a combined wavelength that approximately matches the dominant wavelength of the detected color; and operating the combination of at least two of the plurality of light sources to emit the combined wavelength to be defined as an adapted light that has a discomfort rating at or above the threshold value, wherein at least one of the plurality of light sources is the white light.

2. The method according to claim 1 further comprising the steps of:

determining an illuminance of the detected color; and operating the combination of at least two of the plurality of light sources such that the adapted light has an illuminance approximately equal to the determined illuminance of the detected color.

3. The method according to claim 1 wherein the threshold value is a discomfort glare rating of less than 6 on the De Boer scale.

4. The method according to claim 3 wherein operating the combination of at least two of the plurality of light sources to emit the combined wavelength further comprises altering the adapted light to a new combined wavelength selected in the range between the combined wavelength and 577 nm.

5. The method according to claim 1 wherein at least one of the plurality of light sources comprises a light emitting diode (LED).

6. The method according to claim 1 wherein the lighting device further comprises a conversion engine; wherein the color selection engine is operatively coupled to the conversion engine; and wherein detecting the detected color further comprises:

monitoring for the detected color within a desired illumination range that is based on at least one of a constant, a controlled vehicle speed, an ambient light level, a weather condition, a presence of a vehicle, an absence of a vehicle, and a type of roadway;

receiving a source color signal designating the detected color;

determining RGB values of the detected color;

converting the RGB values of the detected color to XYZ tristimulus values.

7. The method according to claim 6 wherein the dominant wavelength of the detected color is defined as a boundary intersect value within a color space that is collinear with the XYZ tristimulus values of the detected color and the XYZ tristimulus values of a white point, such that the boundary intersect value is closer to the XYZ tristimulus values of the detected color than to the XYZ tristimulus values of the white point.

8. The method according to claim 7 wherein determining the combination of the at least two of the plurality of light sources further comprises identifying a subset of colors within the source wavelength ranges of the source lights emitted by the plurality of light sources such that the subset of colors combine to match the dominant wavelength of the detected color; and choosing two or more of the subset of colors to combine to match the dominant wavelength of the detected color to include a first color of a source wavelength defined as a first color value and a second color of a source wavelength defined as a second color value.

9. The method according to claim 8 wherein the first color value is greater than the dominant wavelength of the detected color; wherein the second value is lesser than the dominant wavelength of the detected color; and wherein none of the remaining subset of colors has a source wavelength nearer to the dominant wavelength of the detected color than either of the first color value and the second color value.

10. The method according to claim 8 wherein the first color value is lesser than the dominant wavelength of the detected color; and wherein none of the subset of colors has a source wavelength greater than the first color value, and none of the subset of colors has a source wavelength lesser than a source wavelength of the second color value.

11. The method according to claim 8 wherein the second color value is greater than the dominant wavelength of the detected color; and wherein none of the subset of colors has a source wavelength lesser than the second color value, and none of the subset of colors has a source wavelength greater than a source wavelength of the first color value.

12. The method according to claim 8 wherein choosing two or more of the subset of colors to combine to match the dominant wavelength of the detected color further comprises:

defining a color line containing the XYZ tristimulus values of the detected color and the XYZ tristimulus values of the white point;

defining a matching line containing XYZ tristimulus values of the first color and XYZ tristimulus values of the second color; and identifying an intersection point of the color line and the matching line, defined as an intersection color;

wherein the method further comprises determining a percentage of the first color value and a percentage of the second color value to combine to match the dominant wavelength of the intersection color.

13. An adaptive anti-glare light system to control a lighting device comprising:

a sensor;

a color selection engine operatively coupled to the sensor;

a controller operatively coupled to the color selection engine; and a plurality of light sources each configured to emit a source light in a source wavelength range, wherein each of the plurality of light sources is operatively coupled to the controller and at least one of the plurality of light sources is a white light;

wherein the sensor is configured to receive a reflected light comprising a detected color;

wherein the color selection engine is configured to perform a matching operation to determine a dominant wavelength of the detected color, and to determine a combination of at least two of the plurality of light sources that emit a combined wavelength that approximately matches the dominant wavelength of the detected color; and wherein the controller is configured to determine if the detected color is characterized by a discomfort glare rating below a threshold level and to operate the combination of at least two of the plurality of light sources to emit the combined wavelength to be defined as an adapted light that has a discomfort rating at or above the threshold value, wherein at least one of the plurality of light sources is the white light.

14. The system according to claim 13 wherein at least one of the plurality of light sources comprises a light emitting diode (LED).

15. The system according to claim 14 wherein the threshold value is a discomfort glare rating of less than 6 on the De Boer scale.

16. The system according to claim 15 wherein the controller is configured to operate the combination of at least two of the plurality of light sources to emit a new combined wavelength selected in the range of wavelengths between the combined wavelength and 577 nm.

17. The system according to claim 13 further comprising a conversion engine; wherein the sensor is configured to monitor for the detected color within a desired illumination range that is based on at least one of a constant, a controlled vehicle speed, an ambient light level, a weather condition, a presence of a vehicle, an absence of a vehicle, and a type of roadway; wherein the conversion engine is configured to perform a conversion operation that receives a source color signal designating the detected color, to determine RGB values of the detected color, and to convert the RGB values of the detected color to XYZ tristimulus values.

18. The system according to claim 17 wherein the dominant wavelength of the detected color is defined as a boundary intersect value within the standardized color space that is collinear with the XYZ tristimulus values of the detected color and XYZ tristimulus values of a white point, and such that the boundary intersect value is closer to the XYZ tristimulus values of the detected color than to the XYZ tristimulus values of the white point.

19. The system according to claim 18 wherein the color selection engine is configured to perform an identifying operation that operates to identify a subset of colors within the source wavelength ranges of the source lights emitted by the plurality of light sources such that the subset of colors combine to match the dominant wavelength of the detected color; and to perform a choosing operation that operates to choose two or more of the subset of colors to combine to match the dominant wavelength of the detected color to include a first color of a source wavelength defined as a first color value and a second color of a source wavelength defined as a second color value.

20. The system according to claim 19 wherein the first color value is greater than the dominant wavelength of the detected color; wherein the second value is lesser than the dominant wavelength of the detected color; and wherein none of the subset of colors has a source wavelength nearer to the dominant wavelength of the detected color than either of the first color value and the second color value.

21. The system according to claim 19 the first color value is lesser than the dominant wavelength of the detected color; and wherein none of the subset of colors has a source wavelength greater than the first color value, and none of the subset of colors has a source wavelength lesser than the second color value.

22. The system according to claim 19 wherein the second color value is greater than the dominant wavelength of the detected color; and wherein none of the subset of colors has a source wavelength lesser than the second color value, and none of the subset of colors has a source wavelength greater than a source wavelength of the first color value.

23. The system according to claim 19 wherein the choosing operation further operates to define a color line containing the XYZ tristimulus values of the detected color and the XYZ tristimulus values of white point, to define a matching line containing the XYZ trisimulus values of the first color and the XYZ trisimulus values of the second color, and to identify an intersection point of the color line and the matching line, defined as an intersection color; wherein the color selection engine is configured to perform a production operation that operates to determine a percentage of the first color value and a percentage of the second color value to combine to match the dominant wavelength of the intersection color.

* * * * *